US008763581B2

(12) United States Patent
Fujiwara et al.

(10) Patent No.: US 8,763,581 B2
(45) Date of Patent: Jul. 1, 2014

(54) INTERNAL COMBUSTION ENGINE AUTOMATIC-STOP/RESTART CONTROL SYSTEM

(75) Inventors: Michitaka Fujiwara, Hyogo (JP); Tsuneo Tanabe, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 311 days.

(21) Appl. No.: 13/278,229

(22) Filed: Oct. 21, 2011

(65) Prior Publication Data

US 2012/0312269 A1 Dec. 13, 2012

(30) Foreign Application Priority Data

Jun. 10, 2011 (JP) ..... 2011-130075

(51) Int. Cl.
*F02N 11/08* (2006.01)

(52) U.S. Cl.
USPC ..... 123/179.4; 123/179.25

(58) Field of Classification Search
USPC ..... 123/179.3, 179.4, 179.25, 179.28; 701/110, 112, 113; 73/114.25, 114.28, 73/114.59
See application file for complete search history.

(56) References Cited

U.S. PATENT DOCUMENTS

| | | | | |
|---|---|---|---|---|
| 6,499,342 | B1 | 12/2002 | Gonzales | |
| 6,626,030 | B2 | 9/2003 | Shimizu | |
| 8,402,849 | B2 * | 3/2013 | Niimi et al. | 74/7 C |
| 8,498,772 | B2 * | 7/2013 | Kanemoto et al. | 701/29.1 |
| 2002/0007244 | A1 | 1/2002 | Shimizu | |
| 2010/0282199 | A1 | 11/2010 | Heyers et al. | |
| 2012/0103292 | A1 * | 5/2012 | Fujiwara et al. | 123/179.4 |
| 2012/0103294 | A1 * | 5/2012 | Kitano et al. | 123/179.25 |
| 2012/0199090 | A1 * | 8/2012 | Kitano et al. | 123/179.4 |
| 2012/0260878 | A1 * | 10/2012 | Kitano et al. | 123/179.3 |

FOREIGN PATENT DOCUMENTS

| | | | |
|---|---|---|---|
| DE | 102006011644 | A1 | 9/2007 |
| JP | 2001-342887 | A | 12/2001 |
| JP | 2004-332599 | A | 11/2004 |
| JP | 2008-210099 | A | 4/2008 |
| WO | 2006/018350 | A2 | 2/2006 |

OTHER PUBLICATIONS

German Office Action, issued Mar. 20, 2013, Patent Application No. 10-2011-088-695.8.
Japanese Office Action dated Aug. 28, 2012 issued in a corresponding Japanese Patent Application No. 2011-130075.

* cited by examiner

*Primary Examiner* — Hai Huynh
(74) *Attorney, Agent, or Firm* — Sughrue Mion, PLLC; Richard C. Turner

(57) ABSTRACT

In an internal combustion engine automatic-stop/restart control system according to the present invention, excellent restartability of an internal combustion engine is ensured in such a way that, while the internal combustion engine inertially rotates after its automatic stop, a solenoid of a starting apparatus for starting the internal combustion engine is driven so that a pinion gear is moved in the axis direction and pushing the pinion gear against a ring gear is started, and detection of a reference signal through a crank angle signal is prohibited until a predetermined period elapses after the pushing has been started so that erroneous reference signal recognition is prevented.

3 Claims, 12 Drawing Sheets

NOTE:
COM = COMPRESSION STROKE INT = INTAKE STROKE
EXH = EXHAUST STROKE POW = POWER STROKE

INTERNAL COMBUSTION ENGINE AUTOMATIC-STOP/RESTART CONTROL SYSTEM

BACKGROUND OF THE INVENTION

1. Field of the Invention

The present invention relates to an internal combustion engine automatic-stop/restart control system that automatically stops an engine (referred to as an internal combustion engine, hereinafter) when an automatic stopping condition is satisfied and then restarts the internal combustion engine when a restarting condition is satisfied.

2. Description of the Related Art

In recent years, for the purpose of improving the gasoline mileage of a motor vehicle and reducing an environmental load, there has been developed an internal combustion engine automatic-stop/restart system that automatically cut off the supply of fuel so as to automatically stop an internal combustion engine, when the operation by a driver satisfies a predetermined condition (e.g., brake-pedal stepping-on operation while the vehicle travels at a speed lower than a predetermined speed) for stopping the internal combustion engine, and then restarts fuel injection so as to automatically restart the internal combustion engine, when the operation by the driver satisfies a predetermined condition (e.g., brake-pedal releasing operation, accelerator stepping-on operation, or the like) for restarting the internal combustion engine.

In this internal combustion engine automatic-stop/restart system, the internal combustion engine performs fuel injection and ignition control in accordance with a crank angle. By being configured in such a way as to generate a crank angle signal pulse every predetermined crank angle as the internal combustion engine rotates, by means of a crank angle sensor for detecting the crank angle of the internal combustion engine, and to generate a cylinder determination signal pulse at a specific crank angle, the internal combustion engine automatic-stop/restart control system knows the crank angle. In general, there are formed teeth-missing portions where outer-circumference teeth of the signal rotor of a rotation sensor are missing, and by utilizing, as a reference signal, an unevenly-spaced pulse generated at the teeth-missing portions, cylinder determination is performed.

In such an internal combustion engine automatic-stop/restart control system as described above, after an idling stop, preparation is made for internal combustion engine restart request while the internal combustion engine inertially rotates; when the internal combustion engine rotation speed becomes the same as or lower than a predetermined rotation speed, the coupling between the pinion gear and the ring gear is started without rotating the starter motor; and at a time point when the motor rotation speed (equal to the pinion gear rotation speed, in this case; the same applies hereinafter) and the internal combustion engine rotation speed synchronize with each other, the coupling between the pinion gear and the ring gear is completed. There has been proposed a system (e.g., refer to Patent Document 1) in which when after the completion of the coupling between the pinion gear and the ring gear, the restart request is issued, the starter motor is energized and the starter motor drives the internal combustion engine so that the restart of the internal combustion engine is completed.

PRIOR ART REFERENCE

Patent Document

[Patent Document 1] National Publication of International Patent Application No. 2008-510099

In the case where such a conventional internal combustion engine automatic-stop/restart control system as described above is utilized, when the internal combustion engine rotation speed becomes the same as or lower than a predetermined rotation speed while the internal combustion engine inertially rotates after an idling stop, the coupling between the pinion gear and the ring gear is started by pressing the pinion gear against the ring gear; however, at this moment, the internal combustion engine rotation speed rapidly decreases and hence the cycle of the crank angle signal pulse is expanded; thus, the crank angle may be recognized as a crank angle that is different from the original crank angle. In such a case, the stroke of each cylinder of the internal combustion engine is erroneously recognized; therefore, there has been a problem that in the case where restarting is performed in this situation, the timing when an injected fuel initially burns is delayed and hence the starting is delayed.

SUMMARY OF THE INVENTION

The present invention has been implemented in order to solve the problems in the foregoing conventional systems; the objective thereof is to provide an internal combustion engine automatic-stop/restart control system that can ensure excellent restartability of an internal combustion engine by preventing a reference signal from the internal combustion engine being erroneously recognized.

An internal combustion engine automatic-stop/restart control system according to the present invention includes a crank angle detection unit that outputs a crank angle signal corresponding to a crank angle of an internal combustion engine; a reference signal output unit that outputs a reference signal in the crank angle signal when the crank angle signal is situated in a predetermined position; a reference signal detection unit that detects a reference signal; a piston position determination unit that determines piston positions of a plurality of cylinders, based on the reference signal in the crank angle signal; an internal combustion engine automatic-stop/restart unit; a starter motor that is energized to rotate; a pinion gear provided on the rotation axle of the starter motor; a plunger for pushing the pinion gear in the axis direction of the rotation axle so that the pinion gear engages with a ring gear provided on a crankshaft of the internal combustion engine; and a solenoid that is energized to move the plunger in the axis direction of the rotation axle. The internal combustion engine automatic-stop/restart control system controls an internal combustion engine in such a way that, while the internal combustion engine inertially rotates after its automatic stop, the solenoid of a starting apparatus for starting the internal combustion engine is driven so that the pinion gear is moved in the axis direction and pushing the pinion gear against the ring gear is started, and detection of the reference signal through the crank angle signal is prohibited until a predetermined period elapses after the pushing has been started.

An internal combustion engine automatic-stop/restart control system according to the present controls an internal combustion engine in such a way that, while the internal combustion engine inertially rotates after its automatic stop, a solenoid of a starting apparatus for starting the internal combustion engine is driven so that a pinion gear is moved in the axis direction and pushing the pinion gear against a ring gear is started, and detection of a reference signal through a crank angle signal is prohibited until a predetermined period elapses after the pushing has been started; therefore, by preventing erroneous reference signal recognition before the internal combustion engine is restarted or when the internal combustion engine is restarted, excellent restartability of the internal combustion engine can be ensured.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
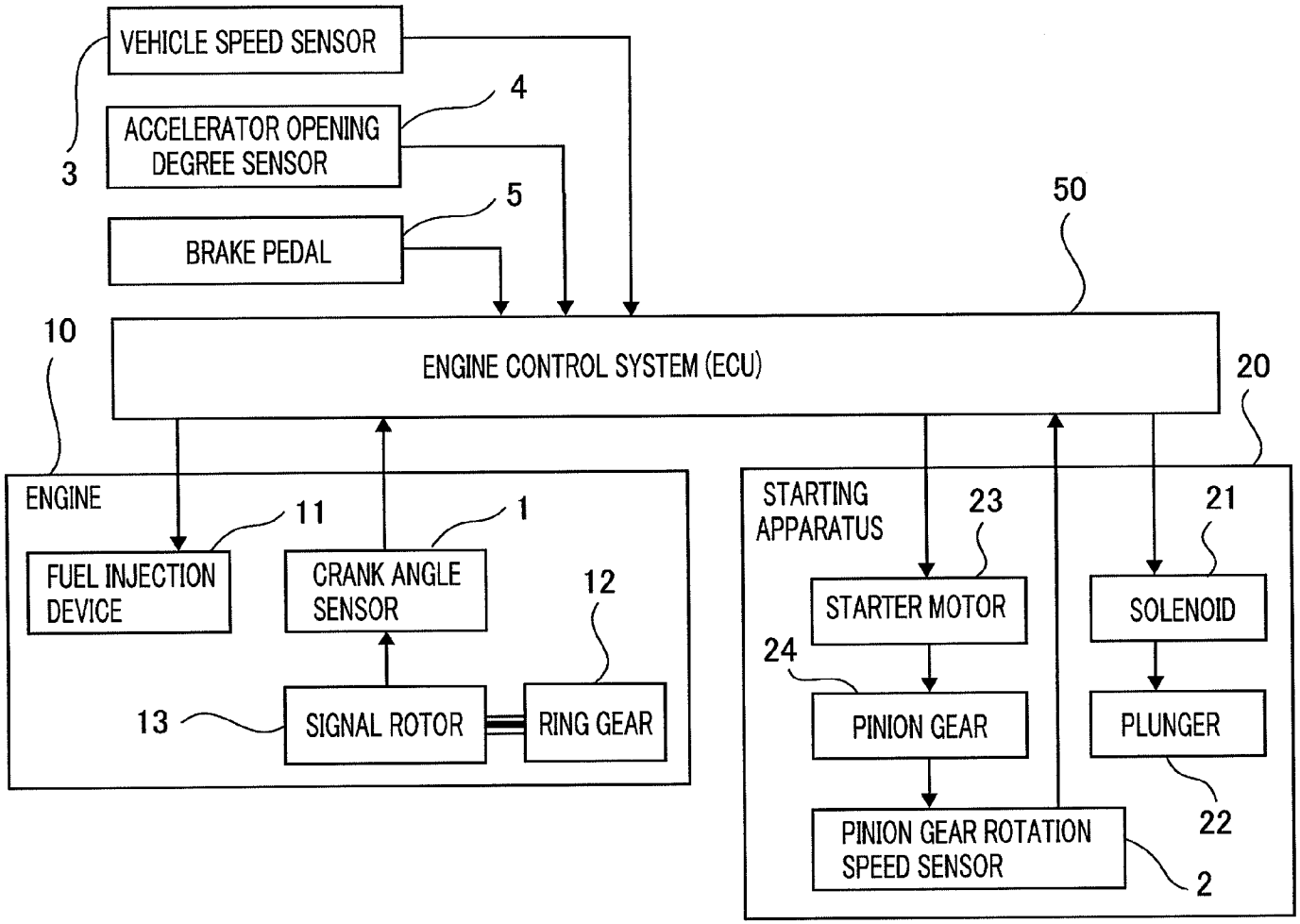
FIG. 1 is an explanatory diagram illustrating the overall configuration of an internal combustion engine automatic-stop/restart control system according to Embodiment 1 of the present invention.

Hereinafter, an internal combustion engine automatic-stop/restart control system according to Embodiment 1 of the present invention will be explained with reference to the drawings. FIG. 1 is a block diagram illustrating the overall configuration of an internal combustion engine automatic-stop/restart control system according to Embodiment 1 of the present invention. In FIG. 1, an internal combustion engine automatic-stop/restart control system according to Embodiment 1 of the present invention is provided with an internal combustion engine 10, a starting apparatus 20, and an internal combustion engine control unit (ECU: Electric Control Unit) 50. The internal combustion engine 10 is provided with a fuel injection device 11 that supplies a fuel to the internal combustion engine 10.

The starting apparatus 20 is provided with a starter motor 23 that rotates when energized, a pinion gear 24 provided on the rotation axle of the starter motor 23, a plunger 22 for pushing the pinion gear 24 in the axis direction thereof so that the pinion gear 24 engages with a ring gear 12 provided on the crankshaft of the internal combustion engine 10, and a solenoid that moves the plunger 22 in the axis direction of the rotation axle thereof when energized.

The internal combustion engine control unit 50 controls the fuel injection device 11 and performs determination on an automatic stopping condition or a restarting condition so that a power source (unillustrated) such as a vehicle battery is connected with the starter motor 23 so as to energize the starter motor 23 or so that the power source is connected with the solenoid 21 so as to energize the solenoid 21.

The internal combustion engine control unit 50 is connected with a crank angle sensor 1 for detecting the crank angle of the internal combustion engine 10, a pinion gear rotation speed sensor 2 that measures the rotation speed of the pinion gear 24 in the starting apparatus 20, a vehicle speed sensor 3 that detects the speed of a vehicle and outputs a vehicle speed signal, an accelerator opening degree sensor 4 that detects an accelerator opening degree and outputs an accelerator opening degree signal, and a brake pedal 5 that outputs a brake signal indicating the state of braking operation.

The crank angle sensor 1 is provided in such a way as to face, through a gap, the outer circumference of a signal rotor 13 that rotates along with the crankshaft (unillustrated) of the internal combustion engine 10. The signal rotor 13 has a plurality of teeth, formed of a magnetic material, that are provided in the circumferential direction thereof in such a way as to be spaced apart from one another by a predetermined gap. The crank angle sensor 1 converts a magnetic change, produced when the teeth of the signal rotor 13 pass through the opposing gap, into an electric signal, generates a crank angle signal corresponding to a crankshaft rotation angle (referred to as a crank angle, hereinafter), and inputs the crank angle signal to the internal combustion engine control unit 50.

The crank angle sensor 1 and the signal rotor 13 form a crank angle detection unit and a reference signal output unit, respectively; the internal combustion engine control unit (ECU) forms a reference signal detection unit for detecting a reference signal, a piston position determination unit for determining piston positions of a plurality of cylinders based on the reference signal in the crank angle signal, and an internal combustion engine automatic-stop/restart unit.

Figure 2:
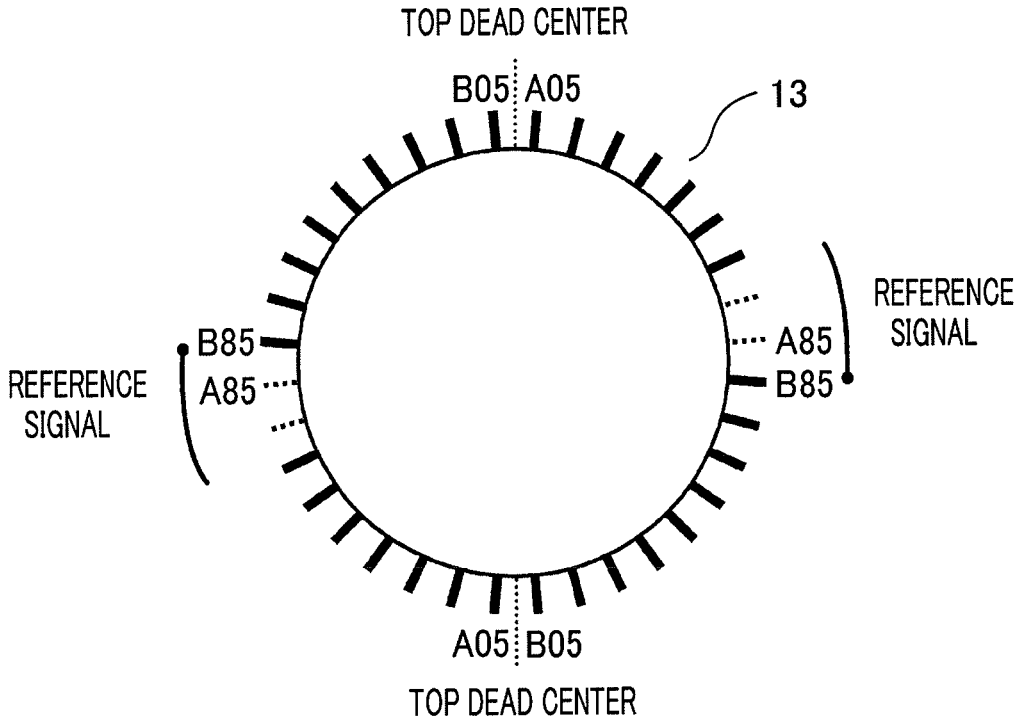
FIG. 2 is an explanatory chart representing the configuration of the signal rotor of a crank angle sensor in an internal combustion engine automatic-stop/restart control system according to Embodiment 1 of the present invention.

The configuration of the signal rotor 13 will be described further in detail. FIG. 2 is an explanatory chart representing the configuration of the signal rotor of the crank angle sensor in the internal combustion engine automatic-stop/restart control system according to Embodiment 1 of the present invention. In FIG. 2, on the outer circumference thereof, the signal rotor 13 is provided with teeth (illustrated with solid lines) formed of magnetic materials. These 32 teeth are provided at 32 positions among 36 positions obtained by equally dividing the outer circumference of the signal rotor 13 in steps of 10° with respect to the center axis of the signal rotor 13. Among the 36 positions on the outer circumference of the signal rotor 13, the rest 4 are the positions for missing teeth (illustrated with broken lines) where no tooth exists.

It is assumed that A05 (denoting 5° after the top dead center) designates the tooth situated at the left side of the position corresponding to the bottommost top dead center in FIG. 2, and A85 designates the missing tooth situated at the position that is the 9th position from the bottommost top dead center when being counted clockwise including the tooth A05. In addition, it is assumed that B85 (denoting 85° before the top dead center) designates the tooth situated at the next position of the missing tooth A85, and B05 designates the tooth situated at the position that is the 9th position from the missing tooth A85 when being counted clockwise including the tooth B85. Furthermore, the tooth following the tooth B05 is designated by A05, and the teeth situated at the positions that are the 8th and 9th positions from the tooth B05 when being counted clockwise including the tooth A05 are missing teeth; the missing tooth situated at that 9th position is designated by A85. In addition, it is assumed that B85 designates the tooth situated at the next position of the missing tooth A85, and B05 designates the tooth situated at the position that is the 9th position from the missing tooth A85 when being counted clockwise including the tooth B85.

The reference signal is formed through the right-hand missing tooth A85 in FIG. 2, the tooth that is 2 positions before the missing tooth A85, the missing tooth immediately before the missing tooth A85, and the tooth immediately after the missing tooth A85, by comparing the cycles of signals from them.

As illustrated in FIG. 2, the reference signal is set at the positions that are spaced 180° apart from each other with respect to the center axis of the signal rotor 13. The reference signal is set in order to determine the respective piston positions of the cylinders based on the crank angle signal.

Figure 3:
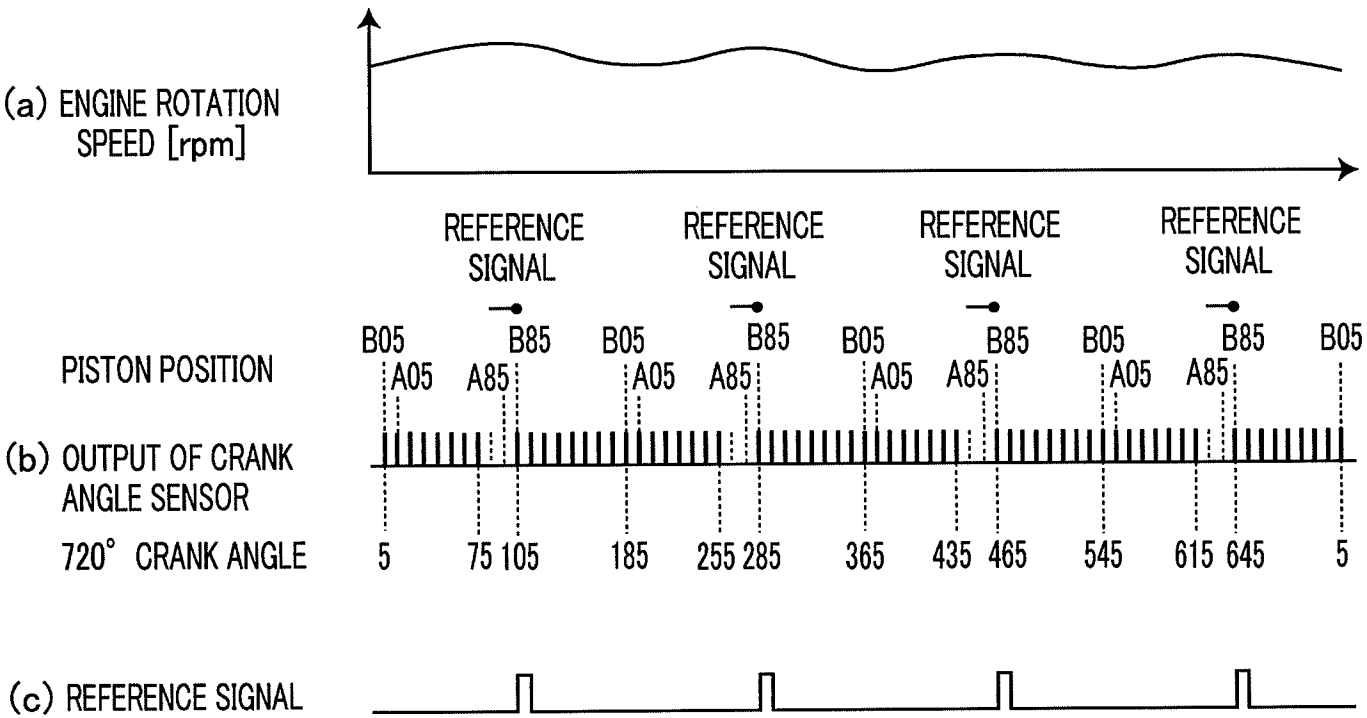
FIG. 3 is an explanatory chart representing the relationship between the output waveform of a crank angle sensor and a reference signal in an internal combustion engine automatic-stop/restart control system according to Embodiment 1 of the present invention.

FIG. 3 is an explanatory chart representing the relationship between the output waveform of the crank angle sensor and the reference signal in an internal combustion engine automatic-stop/restart control system according to Embodiment 1 of the present invention; FIG. 3(*a*) represents the rotation speed of the internal combustion engine, FIG. 3(*b*) represents the output of the crank angle sensor, and FIG. 3(*c*) represents the reference signal; the respective abscissas are in a single and the same temporal sequence. The waveform, represented in FIG. 3(*a*), of the output of the crank angle sensor is the waveform of a signal that is outputted from the crank angle sensor 1 when the signal rotor 13 of the crank angle sensor rotates counterclockwise in synchronization with the rotation of the internal combustion engine; by use of the same reference characters as those of the teeth or the missing teeth of the signal rotor 13, there are represented the waveforms of the crank angle signals that are produced in accordance with the positions on the signal rotor 13 in FIG. 2, i.e., in accordance with the bottommost right-hand tooth B05, as the starting position, the tooth A05, --, A85, B85, B05, A05, --, A85, B85, --, and B05, in that order.

As represented in FIG. 3(*c*), at first, the reference signal is generated in accordance with the crank angles 75°, 85°, 95°, and 105°, while the crankshaft rotates twice (in 720°); next, the reference signal is generated in accordance with the crank angles 255°, 265°, 275°, and 285°; next, the reference signal is generated in accordance with the crank angles 435°, 445°, 455°, and 465°; next, the reference signal is generated in accordance with the crank angles 615°, 625°, 635°, and 645°.

The internal combustion engine control unit 50 calculates the internal combustion engine rotation speed Nr, based on the cycle of the crank angle sensor output signal represented in FIG. 3(*b*), and calculates the pinion gear rotation speed Nst, based on the cycle of a signal outputted from the pinion gear rotation speed sensor 2.

The internal combustion engine control unit (ECU) 50 is configured with various kinds of I/F circuits (unillustrated) and a microcomputer (unillustrated). The microcomputer is configured with an A/D converter (unillustrated) that converts analogue signals such as detection signals from the foregoing various kinds of sensors into digital signals; a CPU (unillustrated) that implements various kinds of programs such as an internal combustion engine automatic-stop/restart control program and the like; a ROM (unillustrated) that stores the internal combustion engine automatic-stop/restart control program, various kinds of control programs and control constants, and various kinds of tables; and a RAM (unillustrated) that stores variables and the like at times when various kinds control programs are implemented.

Figure 4:
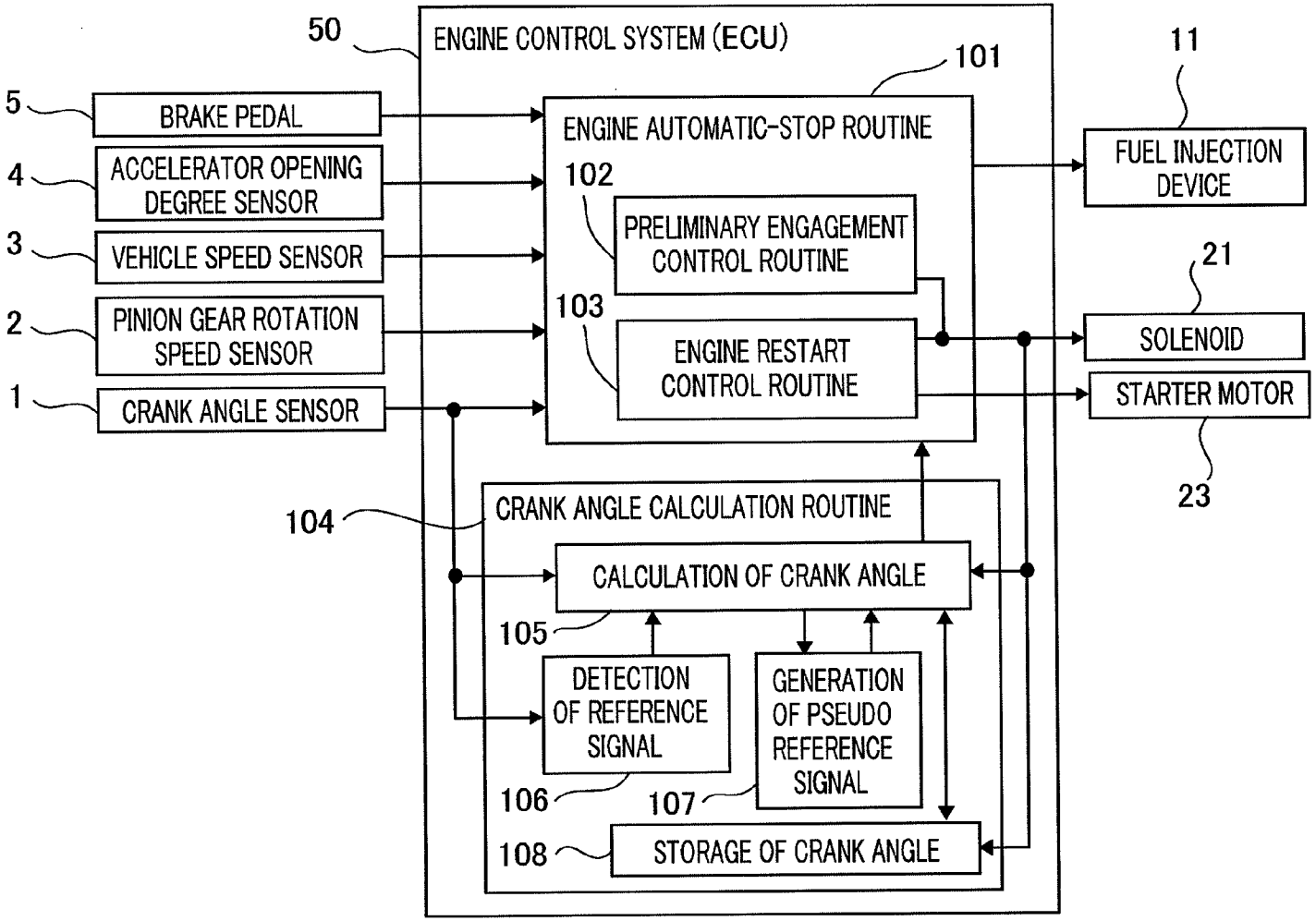
FIG. 4 is a control block diagram of an internal combustion engine automatic-stop/restart control system according to Embodiment 1 of the present invention.

FIG. 4 is a control block diagram of an internal combustion engine automatic-stop/restart control system according to Embodiment 1 of the present invention; the block diagram illustrates the configurations of various processing routines. In FIG. 4, the internal combustion engine control unit 50 is provided with an internal combustion engine automatic stop routine 101, a preliminary engagement control routine 102, an internal combustion engine restart control routine 103, and a crank angle calculation routine 104. The crank angle calculation routine 104 is provided with a crank angle calculation unit 105, a reference signal detection unit 106, a pseudo reference signal generation unit 107, and a crank angle storage unit 108.

Firstly, by use of information items from the vehicle speed sensor 3, the accelerator opening degree sensor 4, the brake pedal 5, and the like, the internal combustion engine automatic stop routine 101 determines whether or not the internal combustion engine has automatically stopped; in the case where it is determined that the internal combustion engine has automatically stopped, the operation of the fuel injection device 11 is stopped. Next, by use of the internal combustion engine rotation speed obtained from the input cycle or the like of the crank angle sensor output signal inputted from the crank angle sensor 1, the preliminary engagement control routine 102 determines whether or not the internal combustion engine rotation speed has become the same as or lower than a predetermined rotation speed; in the case where it is determined that the internal combustion engine rotation speed has become the same as or lower than a predetermined rotation speed, the solenoid 21 is controlled in such a way that the pinion gear 24 is engaged with the ring gear 12.

Next, by use of information items from the accelerator opening degree sensor 4, the brake pedal 5, and the like, the internal combustion engine restart control routine 103 determines whether or not the restarting condition for the internal combustion engine has been satisfied; in the case where it is determined that the restarting condition for the internal combustion engine has been satisfied, the solenoid 21 and the starter motor 23 in the starting apparatus 20 are controlled and, as described later, the fuel injection device 11 and the like are controlled in accordance with the crank angle obtained in the crank angle calculation routine 104, so that the internal combustion engine is restarted.

Next, the crank angle calculation unit 105 in the crank angle calculation routine 104 calculates the crank angle signal from the reference signal detected based on the output value and the output cycle of the crank angle sensor 1 and driving information for the solenoid 21. The reference signal detection unit 106 detects the reference signal based on the cycle of the output signal of the crank angle sensor 1. The pseudo reference signal generation unit 107 generates a pseudo reference signal in accordance with the crank angle. The crank angle storage unit 108 stores the crank angle in accordance with the drive signal for the solenoid 21.

In a predetermined period after the solenoid 21 has driven, the crank angle calculation unit 105 calculates a crank angle by use of the crank angle stored in the crank angle storage unit 108 and the output of the crank angle sensor 1; in the case where the calculated crank angle corresponds to a reference signal generation angle, the crank angle calculation unit 105 makes the pseudo reference signal generation unit 107 generate a reference signal. In contrast, in a period other than the predetermined period after the solenoid 21 has driven, the crank angle calculation unit 105 calculates a crank angle by use of the reference signal detected in the reference signal detection unit 106 and the output of the crank angle sensor 1.

Figure 5:
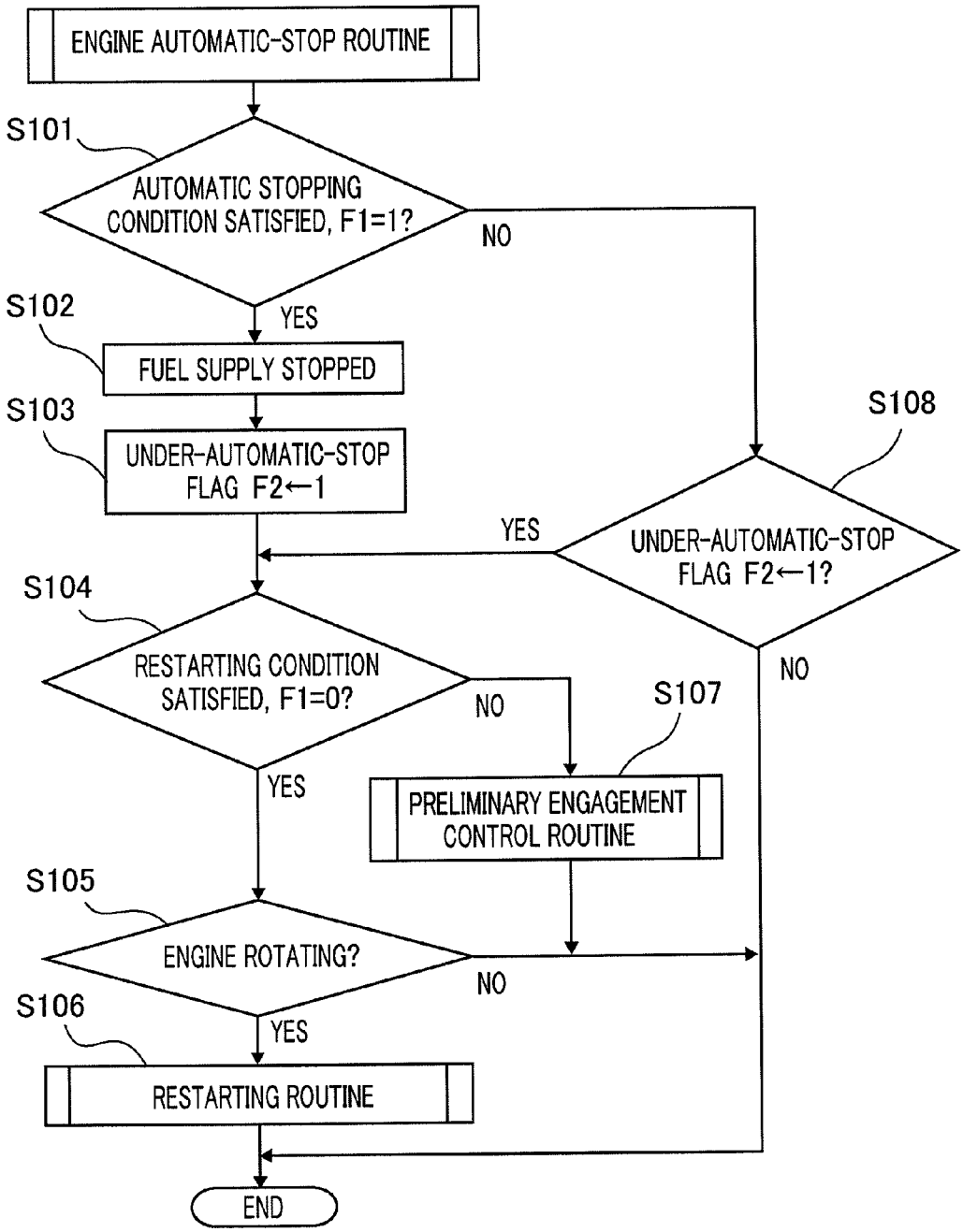
FIG. 5 is a flowchart representing the operation of an internal combustion engine automatic-stop/restart control system according to Embodiment 1 of the present invention.
Figure 6:
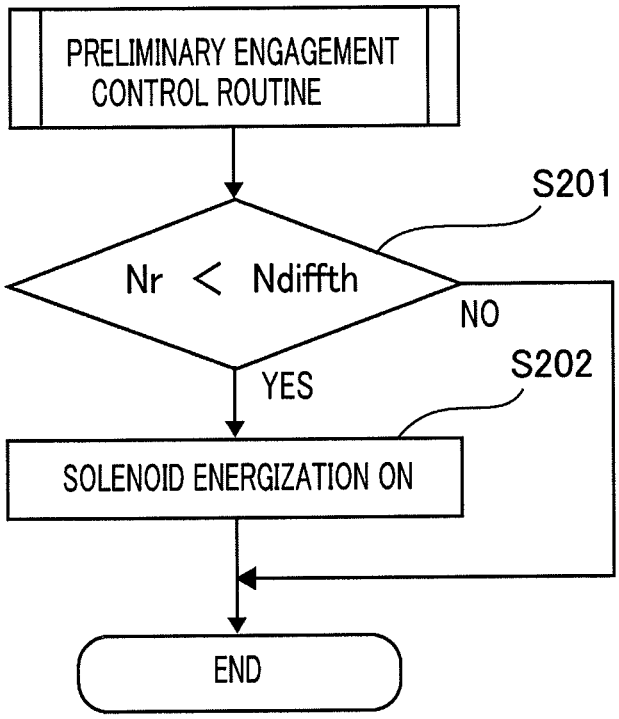
FIG. 6 is a flowchart representing the operation of an internal combustion engine automatic-stop/restart control system according to Embodiment 1 of the present invention.
Figure 7:
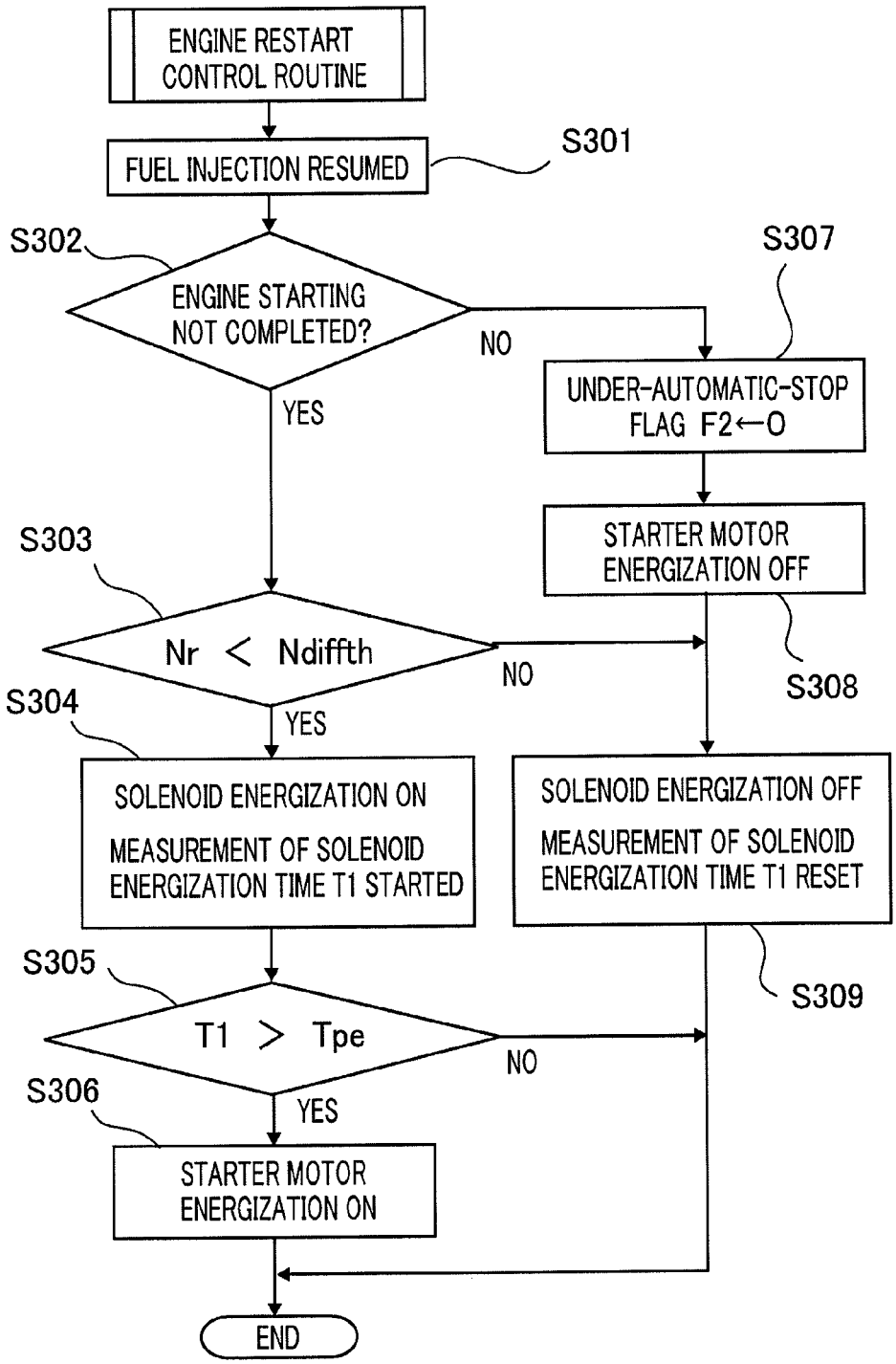
FIG. 7 is a flowchart representing the operation of an internal combustion engine automatic-stop/restart control system according to Embodiment 1 of the present invention.
Figure 8:
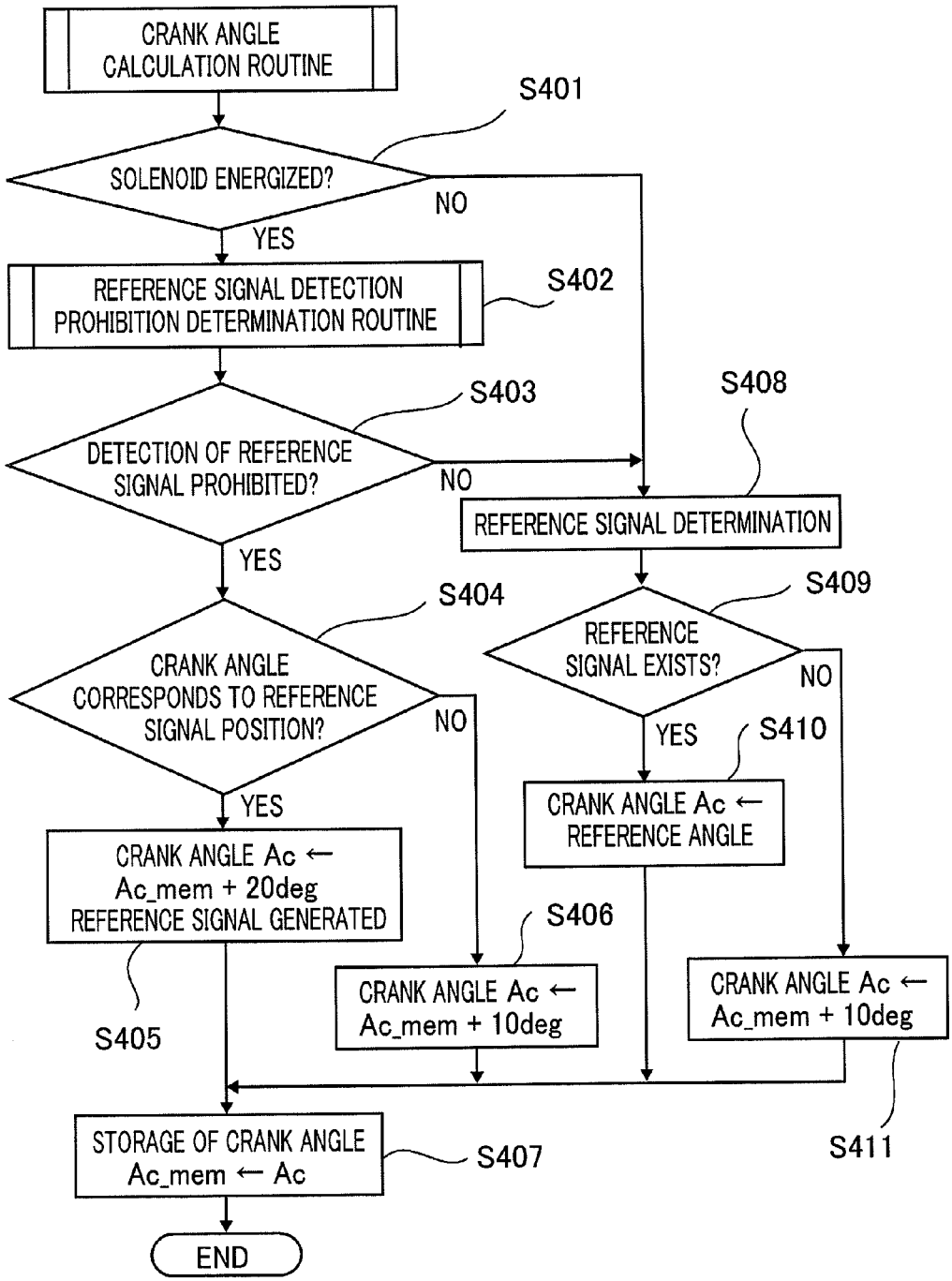
FIG. 8 is a flowchart representing the operation of an internal combustion engine automatic-stop/restart control system according to Embodiment 1 of the present invention.
Figure 9:
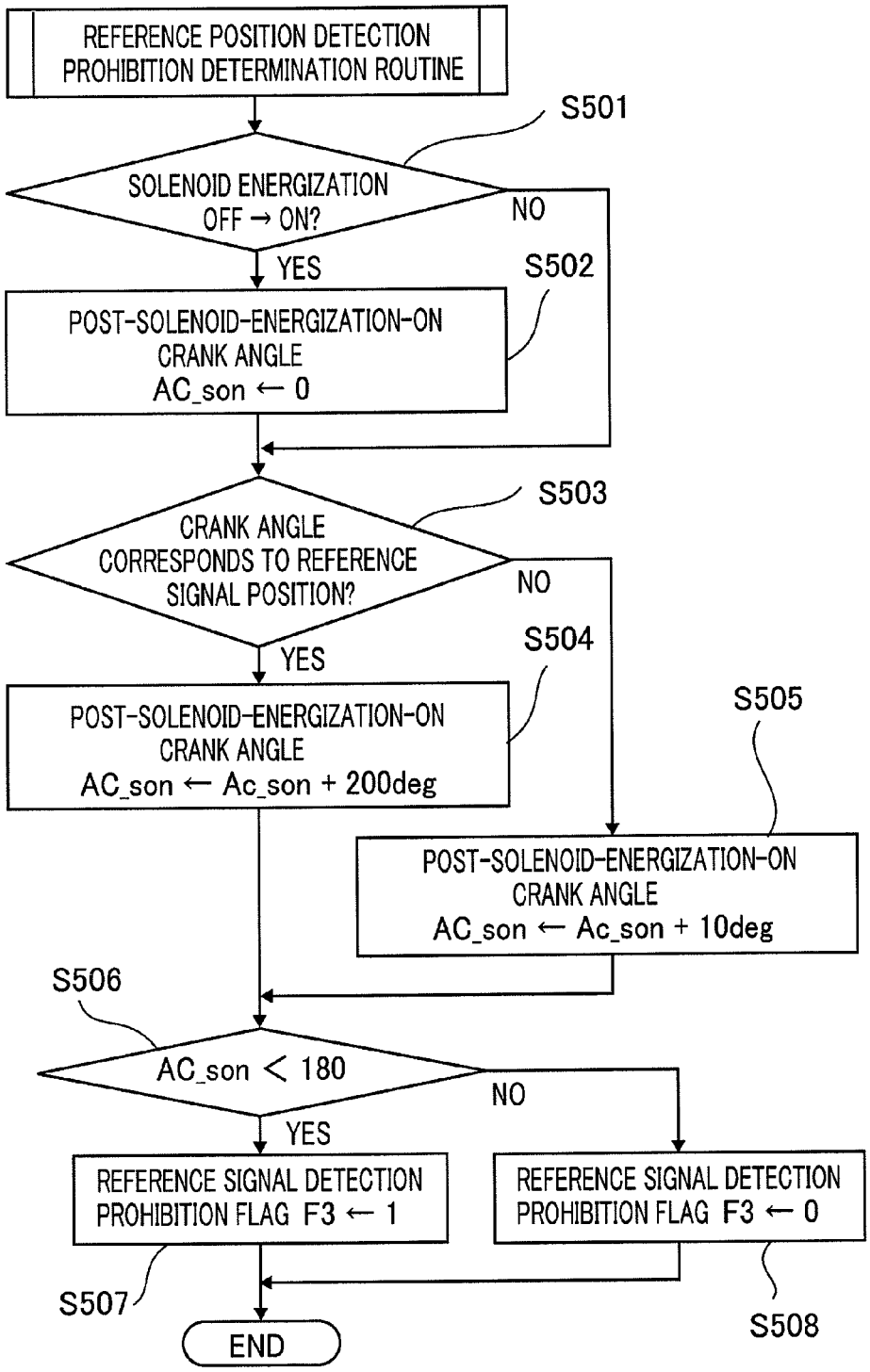
FIG. 9 is a flowchart representing the operation of an internal combustion engine automatic-stop/restart control system according to Embodiment 1 of the present invention.

Each of FIGS. 5 through 9 is a flowchart representing the operation of an internal combustion engine automatic-stop/restart control system according to Embodiment 1 of the present invention; FIG. 5 represents an internal combustion engine automatic stop routine; FIG. 6 represents a preliminary engagement control routine; FIG. 7 represents an internal combustion engine restart control routine; FIG. 8 represents a crank angle calculation routine; FIG. 9 represents a reference position detection prohibition determination routine. The processing items in the steps S101 through S108, S201 through S202, S301 through S309, S401 through S411, and S501 through S508 represented in FIGS. 5 through 9 are performed according to the internal combustion engine automatic-stop/restart control program stored in the ROM of the internal combustion engine control unit 50. The routines represented in FIGS. 5 through 7 are performed in a constant cycle of, for example, 10 [msec]; the routines represented in FIGS. 8 and 9 are performed, for example, each time the output signal from the crank angle sensor 1 is inputted.

When the ignition switch of the vehicle is turned on, the internal combustion engine control unit 50 is supplied with electric power and starts its operation; then, the CPU of the microcomputer in the internal combustion engine control unit 50 implements the internal combustion engine automatic-stop/restart control program.

Firstly, in the internal combustion engine automatic stop routine represented in FIG. 5, in the step S101, the microcomputer of the internal combustion engine control unit 50 (simply referred to as the internal combustion engine control unit 50, hereinafter) determines whether or not the internal combustion engine automatic stopping condition has been satisfied. The automatic stopping condition is, for example, an operation state where the vehicle speed is the same as or lower than 10 [km/h] and the driver is depressing the brake pedal 5. This vehicle speed is based on the vehicle speed signal outputted form the vehicle speed sensor 3, and the state where the brake pedal 5 is being depressed is based on the fact that the brake signal outputted from the brake pedal 5 is "ON". For example, in an operation state where the vehicle speed is the same as or lower than 10 [km/h] and an internal combustion engine automatic stop request flag F1 has been set to "1"; therefore, determination on whether or not the internal combustion engine automatic stopping condition has been satisfied is performed based on whether or not the internal combustion engine automatic stop request flag F1 has been set to "1".

In the case where it is determined in the step S101 that the internal combustion engine automatic stopping condition has been satisfied (YES), the step S101 is followed by the step S102; in the case where the internal combustion engine automatic stopping condition has not been satisfied (NO), the step S101 is followed by the step S108.

In the step S102, the internal combustion engine control unit 50 controls the fuel injection device 11 in such a way that the fuel injection device 11 stops fuel supply to the internal combustion engine 10.

Next, in the step S103, the internal combustion engine control unit 50 sets an under-automatic-stop flag F2 to "1".

Next, in the step S104, the internal combustion engine control unit 50 determines whether or not the restarting condition has been satisfied. This restarting condition is, for example, an operation state where the driver has released the brake pedal and the driver is depressing the accelerator pedal. This operation state where the brake pedal 5 has been released is based on the OFF state of the brake signal, and the state where the accelerator pedal is being depressed is based on the accelerator opening degree signal outputted from the accelerator opening degree sensor 4. In the case where the brake signal outputted from the brake pedal 5 is "OFF" and the accelerator pedal is being depressed, the internal combustion engine automatic stop request flag F1 is cleared to "0"; therefore, whether or not the restarting condition has been satisfied is determined based on whether or not the internal combustion engine automatic stop request flag F1 is "0". In the case where the internal combustion engine automatic stop request flag F1 is "0" (YES), it is determined that the restarting condition has been satisfied, and then the step S104 is followed by the step S105; in the case where the restarting condition has not been satisfied (NO), the step S104 is followed by the step S107.

Next, in the step S105, the internal combustion engine control unit 50 determines whether or not the internal combustion engine 10 is rotating. In the case where the internal combustion engine 10 is rotating (YES), the step 105 is followed by the step 106; in the case where the internal combustion engine 10 is not rotating, i.e., the internal combustion engine 10 is at a complete standstill (NO), the internal combustion engine automatic stop routine represented in FIG. 5 is ended.

After the step S105 is followed by the step S106, the internal combustion engine control unit 50 performs the restart control routine; the detail of the implementation of the restart control routine will be described later.

In the case where it is determined in the step S104 that the internal combustion engine automatic stop request flag F1 is not "0", i.e., the restarting condition has not been satisfied (NO), the step S104 is followed by the step S107. In this situation, the internal combustion engine is in the automatic stop mode; in the step S107, the internal combustion engine control unit 50 implements the preliminary engagement control routine in order to make the pinion gear 24 and the ring gear 12 engage with each other for the preparation of restarting, and then ends the internal combustion engine automatic stop routine represented in FIG. 5. The detail of the implementation of the preliminary engagement control routine in the step S107 will be described later.

In the case where it is determined in the step S101 that the automatic stopping condition has not been satisfied (NO) and then the step S101 is followed by the step S108, the internal combustion engine control unit 50 determines whether or not the under-automatic-stop flag F2 is "1". In the case where the under-automatic-stop flag F2 is "1" (YES), it is determined that the internal combustion engine 10 is in the automatic stop mode, and the step S108 is followed by the step S104, where it is determined whether or not the restarting condition has been satisfied. In contrast, in the case where the under-automatic-stop flag F2 is "0" (NO), it is determined that the internal combustion engine 10 is not in the automatic stop mode, and then the internal combustion engine automatic stop routine is ended.

Next, the preliminary engagement control routine in the step S107 will be described. That is to say, in FIG. 6, in the step S201, the internal combustion engine control unit 50 determines whether or not the internal combustion engine rotation speed Nr is lower than a rotation speed threshold value Ndiffth. In the case where the internal combustion engine rotation speed Nr is lower than the rotation speed threshold value Ndiffth (YES), the step 201 is followed by the step 202; in the case where the internal combustion engine rotation speed Nr is the same as or higher than the rotation speed threshold value Ndiffth (NO), the preliminary engagement control routine represented in FIG. 6 is ended.

The foregoing rotation speed threshold value Ndiffth is a value, for example, 100 [rpm] at which the pinion gear 24 and the ring gear 12 can engage with each other. In general, the number of teeth of the pinion gear 24 is smaller than that of the ring gear 12; in order to avoid confusion, there are utilized values obtained by converting the internal combustion engine rotation speed Nr and the pinion gear rotation speed Nst into the rotation speeds at the ring gear 12, in consideration of the ratio of the number of teeth of the pinion gear 24 to that of the ring gear 12.

In the step S202, the internal combustion engine control unit 50 turns on the energization of the solenoid 21. Moreover, the internal combustion engine control unit 50 starts measurement of the energization time T1 for the solenoid 21 and ends the implementation of the preliminary engagement control routine in FIG. 6.

Next, there will be explained the detail of the implementation of the restart control routine performed in the step S106. That is to say, in FIG. 7, in the step S301, the internal combustion engine control unit 50 controls the fuel injection device 11 in such a way that the fuel injection device 11 injects a starting fuel into the internal combustion engine 10.

Figure 10:
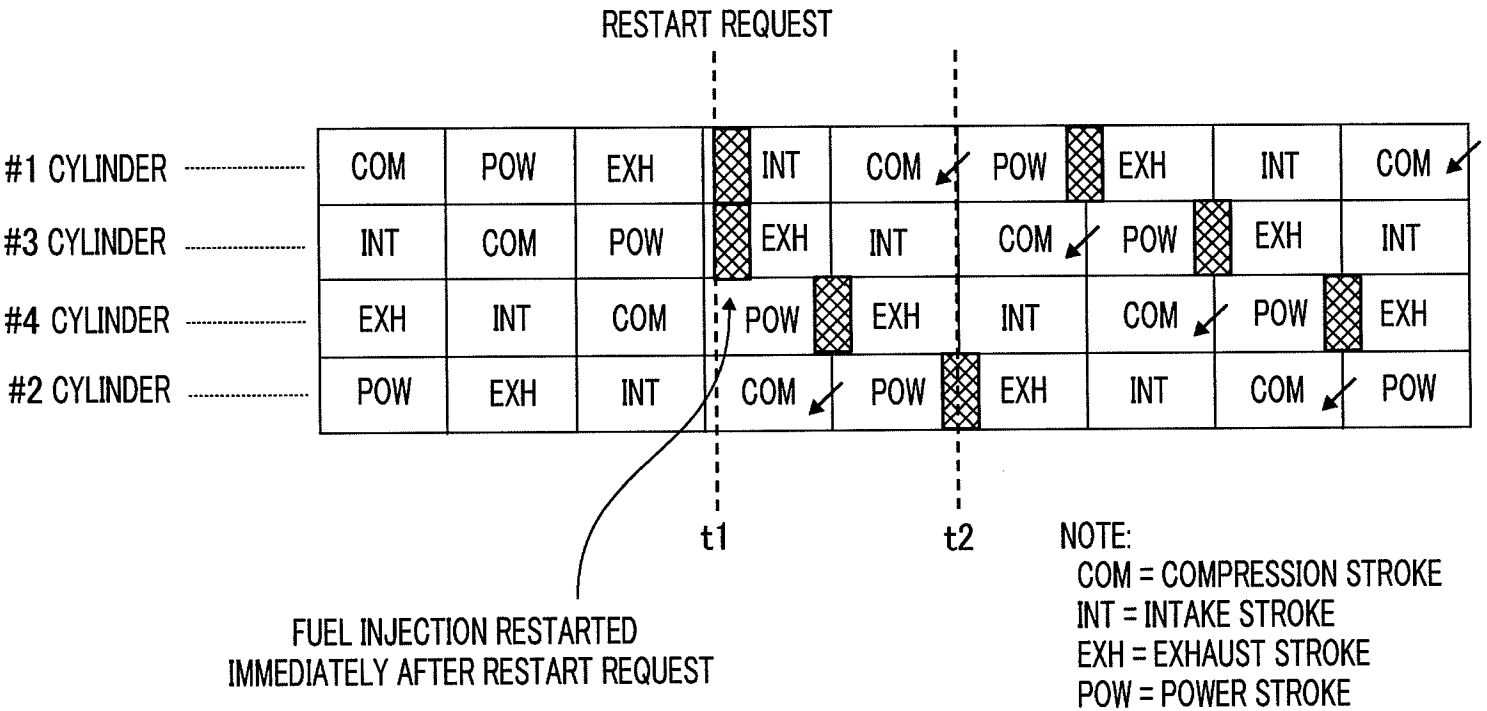
FIG. 10 is an explanatory chart for explaining fuel injection at a time when there is restarted an internal combustion engine in an internal combustion engine automatic-stop/restart control system according to Embodiment 1 of the present invention.

Here, there will be explained fuel injection at a time when the internal combustion engine 10 is restarted. FIG. 10 is an explanatory chart for explaining fuel injection at a time when there is restarted an internal combustion engine in an internal combustion engine automatic-stop/restart control system according to Embodiment 1 of the present invention. FIG. 10 represents a case where internal combustion engine 10 has four cylinders; in the chart, the arrows each denote ignition timings. While the internal combustion engine is in the automatic stopping mode, ignition is interrupted; then, after engine restarting has begun, ignition is resumed at a predetermined timing (at the crank angle BTDC 05° of each compression-stroke cylinder). The hatched portions in FIG. 10 each indicate fuel injection timings. While the internal combustion engine is in the automatic stopping mode, fuel injection is interrupted; when restarting is begun at a time instant t1 in FIG. 10, there is resumed, approximately at the time instant t1, fuel injection in a plurality of predetermined cylinders, i.e., in #1 cylinder in the intake stroke and #3 cylinder in the exhaust stroke; after that, fuel injection is resumed every predetermined timing (at the crank angle BTDC 5° of each power-stroke cylinder). After the restarting has begun at the time instant t1, the fuel that has been injected approximately at the time instant t1 starts to burn due to ignition resumed at a time instant t2.

In the step S301 in FIG. 7, fuel injection is resumed as described above; next, in the step S302, based on the internal combustion engine rotation speed, the internal combustion engine control unit 50 determines whether or not the internal combustion engine 10 has started. In the case where the internal combustion engine 10 has not started, i.e., in the case where the internal combustion engine rotation speed is lower than a predetermined value (YES), the step S302 is followed by the step S303. In contrast, in the case where the internal combustion engine 10 has started, i.e., in the case where the internal combustion engine rotation speed is the same as or higher than the predetermined value (NO), it is determined that the internal combustion engine 10 has started through burning; then, the step 302 is followed by the step S307. In this embodiment, the predetermined value with which it is determined whether or not the engine has started is, for example, 500 [rpm].

Next, in the step S303, the internal combustion engine control unit 50 determines whether or not the internal combustion engine rotation speed Nr is lower than the rotation speed threshold value Ndiffth. In the case where the internal combustion engine rotation speed Nr is lower than the rotation speed threshold value Ndiffth (YES), the step 303 is followed by the step 304; in the case where the internal combustion engine rotation speed Nr is the same as or higher than the rotation speed threshold value Ndiffth (NO), the step 303 is followed by the step 309.

In the step S304, the internal combustion engine control unit 50 turns on the energization of the solenoid 21. Moreover, the engine automatic transmission control system 50 starts the measurement of the energization time T1 for the solenoid 21.

Next, in the step S305, the internal combustion engine control unit 50 determines whether or not the energization time T1 for the solenoid 21 is longer than a predetermined time Tpe. In the case where the energization time T1 for the solenoid 21 is longer than the predetermined time Tpe, i.e., it is determined that the pinion gear 24 has been pushed against and engaged with the ring gear 12 (YES); the step S305 is followed by the step S306. In the case where the energization time T1 for the solenoid 21 is shorter than the predetermined time Tpe, i.e., it is determined that the pinion gear 24 has not been pushed against and engaged with the ring gear 12 (NO); the internal combustion engine restart control routine in FIG. 7 is ended. In this Embodiment, the predetermined time Tpe is, for example, 50 [msec].

In the case where it is determined in the step S302 that the internal combustion engine has been started (NO) and then the step S302 is followed by the step S307, the internal combustion engine control unit 50 resets the under-automatic-stop flag F2 to "0" because the internal combustion engine has been restarted.

Next, in the step S308, the internal combustion engine control unit 50 turns off the energization of the starter motor 23 of the starting apparatus 20.

Next, in the step S309, the internal combustion engine control unit 50 turns off the energization of the solenoid 21 of the starting apparatus 20. Moreover, the internal combustion engine control unit 50 ends and resets the measurement of the energization time T1 for the solenoid 21. In this case, because no attractive force is exerted between the solenoid 21 and the plunger 22, the plunger 22 does not move in the axis direction of the rotation axle of the starter motor 23; therefore, the pinion gear 24 is not pushed out in the axis direction thereof, whereby the pinion gear 24 and the ring gear 12 do not engage with each other.

Next, implementation of the crank angle calculation routine will be explained. That is to say, in FIG. 8, in the step S401, the internal combustion engine control unit 50 determines whether or not the energization of the solenoid 21 is ON. In the case where the energization of the solenoid 21 is ON, the step S401 is followed by the step S402. In the case where the energization of the solenoid 21 is OFF, the step S401 is followed by the step S408.

In the step S402, through a reference signal detection prohibition determination routine represented in FIG. 9, described later, the internal combustion engine control unit 50 determines whether or not detection of a reference signal through the cycle of the output of the crank angle sensor should be prohibited.

Next, in the step S403, the internal combustion engine control unit 50 determines whether or not the detection of the reference signal is prohibited. In this Embodiment, the case where the detection of the reference signal is prohibited is a case where due to energization of the solenoid 21, the pinion gear 24 is pushed against the ring gear 12 and hence the internal combustion engine rotation speed is reduced; a reference signal detection prohibition flag F3 is set to "1". In contrast, in the case where it is conceivable that after the pinion gear 24 is pushed against the ring gear 12 due to the energization of the solenoid 21, the internal combustion engine rotation speed is not reduced any more, detection of the reference signal is not prohibited, and the reference signal detection prohibition flag F3 becomes "0". The determination in the step S403 on whether or not the detection of the reference signal is prohibited is performed based on whether or not the reference signal detection prohibition flag F3 is "1". In the case where it is determined in the step S403 that the detection of the reference signal is prohibited (YES), the step S403 is followed by the step S404; in the case where the detection of the reference signal is not prohibited (NO), the step S403 is followed by the step S408. In addition, the details of the reference signal detection prohibition determination routine will be explained later.

In the step S404, the internal combustion engine control unit 50 determines whether or not a crank angle Ac_mem that has been updated last time is a predetermined crank angle before a missing tooth, i.e., whether or not the crank angle corresponds to the reference signal generation position. In the case where it is determined that the crank angle Ac_mem that has been updated last time is a predetermined crank angle before a missing tooth (YES), the step S404 is followed by the step S405; in the case where the crank angle Ac_mem that has been updated last time is not a predetermined crank angle before a missing tooth (NO), the step S404 is followed by the step S406. In this situation, the predetermined crank angle is 75°, 255°, 435°, and 615° within the crank angle of 720° represented in FIG. 3.

In the case where it is determined in the step S404 that the crank angle Ac_mem that has been updated last time is a predetermined crank angle before a missing tooth (YES), the step S404 is followed by the step S405; then, because the last-time crank angle Ac_mem is before a missing tooth, 20° is added to the last-time crank angle Ac_mem so that the crank angle Ac is updated. Moreover, the reference signal is generated and is utilized for detecting an abnormality in the crank angle sensor or the like and for performing other controls.

In contrast, in the case where it is determined in the step S404 that the crank angle Ac_mem that has been updated last time is not a predetermined crank angle before a missing tooth (NO), the step S404 is followed by the step S406; then, because the last-time crank angle Ac_mem is not before a missing tooth, 10° is added to the last-time crank angle Ac_mem so that the crank angle Ac is updated.

Next, in the step S407, the internal combustion engine control unit 50 stores, as the last-time crank angle Ac_mem, the crank angle Ac that is updated in the step S405 or in the step S406, and ends the crank angle calculation routine in FIG. 8.

Meanwhile, in the case where it is determined in the step S401 that the energization of the solenoid 21 is not "ON" (NO) and then the step S401 is followed by the step S408, the internal combustion engine control unit 50 detects (determines) the reference signal from the output of the crank angle sensor 1; then, the step S408 is followed by the step S409. With regard to the method of detecting the reference signal, for example, the cycle of the output of the crank angle sensor 1 is recorded, and in the case where the ratio of the present cycle to the last-time cycle is larger than a predetermined value, it is considered that the reference signal has been detected.

Next, in the step S409, the internal combustion engine control unit 50 determines whether or not the reference signal exists; in the case where the reference signal exists (YES), the step S409 is followed by the step S410; in the case where the reference signal does not exist (NO), the step S409 is followed by the step S411.

In the step S410, a crank angle at which the reference signal is outputted is substituted for the crank angle Ac; then the step S410 is followed by the step S407. In this Embodiment, the crank angle that is substituted is, for example, the crank angle, corresponding to the present reference signal, that is closest to the last-time crank angle Ac_mem (when AC_mem is 65°, the crank angle is 105°).

In contrast, in the case where it is determined in the step S409 that the reference signal does not exist (NO) and then the step S409 is followed by the step S411, 10° is added to the last-time crank angle Ac_mem, so that the crank angle Ac is updated; then, the step S411 is followed by the step S407.

Next, the foregoing reference signal detection prohibition determination routine will be explained with reference to FIG. 9. The "reference position detection prohibition determination routine" described in FIG. 9 denotes the foregoing "reference signal detection prohibition determination routine". In FIG. 9, in the step S501, the internal combustion engine control unit 50 determines whether or not the energization of the solenoid 21 has been switched from OFF to ON. In the case where it is determined that the energization of the solenoid 21 has been switched from OFF to ON (YES), the step S501 is followed by the step S502; in the case where it is determined that the energization of the solenoid 21 has not been switched from OFF to ON, i.e., the energization of the solenoid 21 is kept OFF (NO), the step S501 is followed by the step S503.

In the step S502, the internal combustion engine control unit 50 initializes a post-solenoid-energization-ON crank angle Ac_son to "0°".

Next, in the step S503, the internal combustion engine control unit 50 determines whether or not the crank angle Ac_mem that has been updated last time is a predetermined crank angle before a missing tooth, i.e., an angle corresponding to a reference signal position. In the case where it is determined that the crank angle Ac_mem that has been updated last time is a predetermined crank angle before a missing tooth (YES), the step S503 is followed by the step S504; in the case where the crank angle Ac_mem that has been updated last time is not a predetermined crank angle before a missing tooth (NO), the step S503 is followed by the step S505.

In the step S504, the internal combustion engine control unit 50 updates the post-solenoid-energization-ON crank angle Ac_son. In other words, because the last-time crank angle Ac_mem is before a missing tooth, a new post-solenoid-energization-ON crank angle Ac_son is obtained by adding 20'; then, the step S504 is followed by the step S506.

In contrast, in the step S505, the internal combustion engine control unit 50 updates the post-solenoid-energization-ON crank angle Ac_son. In other words, because the last-time crank angle Ac_mem is not before a missing tooth, a new post-solenoid-energization-ON crank angle Ac_son is obtained by adding 10°; then, the step S505 is followed by the step S506.

Next, in the step S506, the engine automatic transmission control system 50 determines whether or not the post-solenoid-energization-ON crank angle Ac_son is smaller than a predetermined value. In the case where the post-solenoid-energization-ON crank angle Ac_son is smaller than a predetermined value (YES), the step S506 is followed by the step S507. In the case where the post-solenoid-energization-ON crank angle Ac_son is the same as or larger than a predetermined value (NO), the step S506 is followed by the step S508. In this Embodiment, the predetermined value is, for example, 180°.

In the step S507, because the post-solenoid-energization-ON crank angle Ac_son is smaller than the predetermined value, the internal combustion engine control unit 50 sets the reference signal detection prohibition flag F3 to "1" and ends the determination routine in FIG. 9.

In the step S508, because the post-solenoid-energization-ON crank angle Ac_son is the same as or larger than the predetermined value, the internal combustion engine control unit sets the reference signal detection prohibition flag F3 to "0" and ends the determination routine in FIG. 9.

Figure 11:
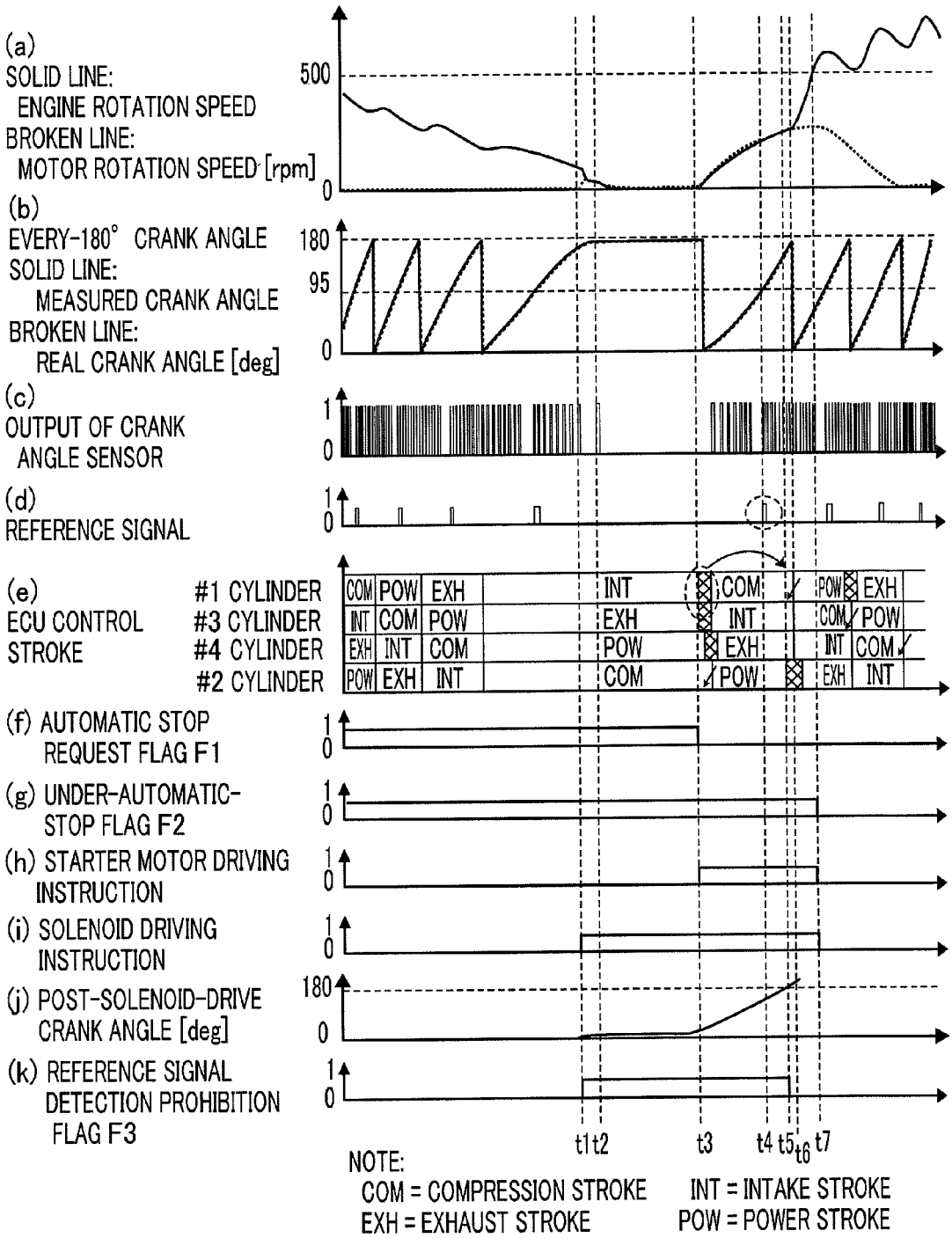
FIG. 11 is a timing chart representing the post-restart operation of an internal combustion engine in an internal combustion engine automatic-stop/restart control system according to Embodiment 1 of the present invention.

Next, the operation of the internal combustion engine automatic-stop/restart control system according to Embodiment 1 of the present invention will be explained with reference to timing charts. FIG. 11 is a timing chart representing the post-restart operation of an internal combustion engine in an internal combustion engine automatic-stop/restart control system according to Embodiment 1 of the present invention. The timing chart in FIG. 11 represents the operation performed in the case where the internal combustion engine is automatically stopped when the vehicle is travelling, the pinion gear 24 and the ring gear 12 are engaged with each other while the internal combustion engine rotates, and then the internal combustion engine is restarted through cranking by the starter motor 23.

In FIG. 11, FIG. 11(*a*) represents the temporal transitions of the internal combustion engine rotation speed Nr (solid line) and the starter motor rotation speed, i.e., the pinion gear rotation speed Nst (dotted line). FIG. 11(*b*) represents the temporal transitions of the every-180° crank angle (solid line) that is recognized by the internal combustion engine control unit and the real every-180° crank angle (dotted line). FIG. 11(*c*) represents the temporal transition of the output of the crank angle sensor. FIG. 11(*d*) represents the temporal transition of the reference signal utilized for controlling the internal combustion engine; when existing, the reference signal is set to "1"; when not existing, the reference signal is cleared to "0".

In addition, FIG. 11(*e*) represents the respective strokes, of the cylinders, that are recognized by the internal combustion engine control unit (ECU) 50; the hatched portion and the arrow indicate fuel injection and ignition, respectively. FIG. 11(*f*) represents the state of the automatic stop request flag F1; in the case where the automatic stopping condition is satisfied, the automatic stop request flag F1 is set to "1", and in the case where the restarting condition is satisfied, the automatic stop request flag F1 is reset to "0". FIG. 11(*g*) represents the state of the under-automatic-stop flag F2; in the case where the internal combustion engine 10 is in the automatic stop mode, the under-automatic-stop flag F2 is set to "1", and in the case where the internal combustion engine 10 has been started, the under-automatic-stop flag F2 is reset to "0".

FIG. 11(*h*) represents the temporal transition of the energization state of the starter motor 23. FIG. 11(*i*) represents the temporal transition of the energization state of the solenoid 21. FIG. 11(*j*) represents the temporal transition of the crank angle changing amount after the energization state of the solenoid 21 has been started. FIG. 11(*k*) represents the temporal transition of the reference signal detection prohibition flag F3; in the case where reference signal detection based on the output of the crank angle sensor is prohibited, the reference signal detection prohibition flag F3 is set to "1"; in the case where reference signal detection based on the output of the crank angle sensor is allowed, the reference signal detection prohibition flag F3 is set to "0".

In FIG. 11, at first, it is assumed that the automatic stopping condition has been satisfied, the automatic stop request flag F1 has been set to "1", fuel injection has been stopped, and the under-automatic-stop flag F2 has been set to "1" (corresponding to steps S101 through S103 in FIG. 5). After that, when at a time point t1, the internal combustion engine rotation speed becomes lower than a predetermined rotation speed, the energization of the solenoid is turned on in preparation for restarting of the internal combustion engine (corresponding to the steps S201 through S202 in FIG. 6), so that pushing of the pinion gear 24 is started.

After that, because in a time between the time point t1 and a time point t2, the pinion gear 24 is pushed against the ring gear 12, the internal combustion engine rotation speed Nr indicated by a solid line in FIG. 11(*a*) is decelerated; the motor rotation speed indicated by a dotted line, i.e., the pinion gear rotation speed Nst is accelerated; and at the time point when the rotations of the pinion gear 24 and the ring gear synchronize with each other, the engagement between the pinion gear 24 and the ring gear 12 is completed. At this time, because in the time between the time point t1 and the time point t2, the internal combustion rotation speed Nr is rapidly decelerated, as represented in FIG. 11(*a*), the output cycle of the output of the crank angle sensor is prolonged. However, as explained with reference to FIG. 9, detection of the reference signal represented in FIG. 11(*d*) through the cycle of the output of the crank angle sensor 1 is stopped in a predetermined time, for example, 180° in crank angle, after the energization of the pinion gear 24 has been turned on (FIG. 9); therefore, because as represented in FIG. 11(*k*), the reference signal detection prohibition flag F3 is set to "1", the reference signal is prevented from being erroneously detected.

Next, at a time point t3, due to the driver's operation, the restarting condition is satisfied; then, the automatic stop request flag F1 represented in FIG. 11(*f*) becomes "0", and fuel injection and ignition are resumed. At the time point t3, in order to facilitate the restart, fuel injection into #1 cylinder in the intake stroke and #3 cylinder in the exhaust stroke are asynchronously performed, as represented in FIG. 11(*e*). The starting of the internal combustion engine 10 has not been completed, and as represented in FIG. 11(*i*), a sufficient time has elapsed after the issue of a solenoid driving instruction, i.e., the start of the energization of the solenoid and hence the engagement between the pinion gear 24 and the ring gear 12 has been completed; thus, a starter motor driving instruction is issued and the starter motor 41 is energized to start rotating (corresponding to the steps 305 through 306 in FIG. 7).

Next, because at a time point t4, as represented in FIG. 11(*k*), the reference signal detection prohibition flag F3 has been set to "1" and reference signal detection based on the cycle of the output of the crank angle sensor 1 is prohibited, the crank angle is obtained from the output of the crank angle sensor 1 and the stored last-time crank angle; because the obtained crank angle is a crank angle at which the reference signal is outputted, the reference signal is outputted as represented in FIG. 11(*d*), and the reference signal is utilized in other control, as may be necessary (corresponding to the steps S404 through S405 in FIG. 8).

Next, when it is assumed that the crank angle at a time instant when the energization of the solenoid 21 is turned on is a reference (0°) and the result of integration of crank angles from the reference exceeds 180°, there increases the rotation speed of the internal combustion engine, which rotates by being driven by the starter motor 23 through the intermediary of the pinion gear 24 and the ring gear 12; because at a time point t5, the internal combustion engine rotation speed apparently falls out of a range where the reference signal is erroneously detected, the reference signal detection prohibition flag F3 is cleared to "0" (steps S506 through S508 in FIG. 9). After that, the reference signal is detected from the cycle of the output of the crank angle sensor 1.

Next, at a time point t6, the fuel injected at a time of restart is ignited; at a time point t7, due to the combustion, the internal combustion engine rotation speed Nr becomes the same as or higher than an internal combustion engine starting completion determination rotation speed and hence restarting of the internal combustion engine is completed; the automatic stop request flag F1 represented in FIG. 11(*f*) is reset to "0"; then, the starter motor driving instruction represented in FIG. 11(*h*) and the solenoid driving instruction represented in FIG. 11(*i*) are cancelled. The reference signal is prevented from being erroneously detected in such a way as described above, so that a correct crank angle is obtained and hence no delay in starting is caused.

Figure 12:
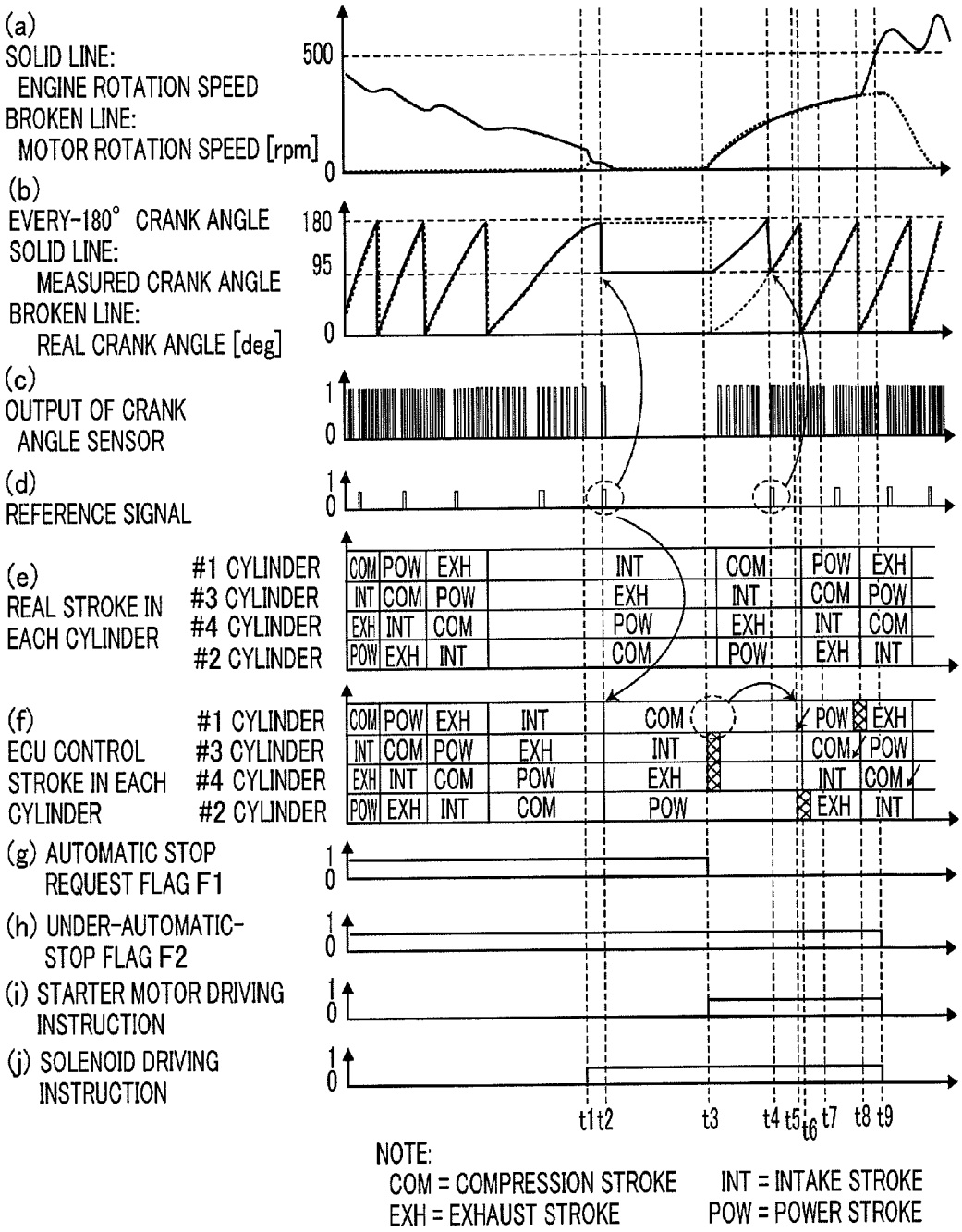
FIG. 12 is a timing chart-representing the operation of a conventional internal combustion engine automatic-stop/restart control system.

Here, the operation of the foregoing conventional system will be explained in comparison to an internal combustion engine automatic-stop/restart control system according to Embodiment 1 of the present invention. FIG. 12 is a timing chart representing the operation of the conventional internal combustion engine automatic-stop/restart control system; FIGS. 12(*a*) through 12(*d*) correspond to FIGS. 11(*a*) through 11(*d*). FIG. 12(*e*) represents the respective real strokes of the cylinders; FIG. 12(*f*) represents the respective ECU control strokes of the cylinders; FIG. 12(*g*) represents the automatic stop request flag F1; FIG. 12(*h*) represents the under-automatic-stop flag F2; FIG. 12(*i*) represents the starter motor driving instruction; and FIG. 12(*j*) represents the solenoid driving instruction.

As represented in FIG. 12, in the case where such a conventional internal combustion engine automatic-stop/restart control system as described above is utilized, when the internal combustion engine rotation speed becomes the same as or lower than a predetermined rotation speed while the internal combustion engine inertially rotates after an idling stop, the coupling between the pinion gear and the ring gear is started by pressing the pinion gear against the ring gear (at, a time point t1 in FIG. 12). At this time, because the solenoid is driven and pushed against the pinion gear, the internal combustion engine rotation speed is rapidly reduced and hence the cycle of the crank angle signal pulse is expanded (prolonged); thus, the crank angle signal pulse may erroneously be recognized as an unevenly-spaced pulse that is generated at a missing tooth. Accordingly, the crank angle obtained from the erroneously recognized unevenly-spaced pulse (reference signal) may be recognized as an erroneous crank angle that is different from an authentic crank angle (at a time point t2 in FIG. 12).

In such a case, the strokes in each cylinder become erroneous (at the time point t2 in FIGS. 12(*e*) and 12(*f*)). In the case where under this condition, restarting is performed, fuel control and ignition control for starting is performed with the crank angle left erroneous; for example, in the case where in order to facilitate the restart, fuel is asynchronously injected into a cylinder in the intake stroke and a cylinder in the exhaust stroke concurrently with the restart, fuel is injected into an erroneous cylinder (at a time point t3 in FIG. 12(*f*)). After that, even if a missing tooth is detected and a correct crank angle is obtained (at a time point t4 in FIG. 12), there occurs no combustion in #1 cylinder in which originally, combustion through ignition could occur. As a result, there has been a problem that the timing when an injected fuel initially burns is delayed (at a time point t8 in FIG. 12) and hence the starting is delayed.

As described above, in the internal combustion engine automatic-stop/restart control system according to Embodiment 1 of the present invention, reference signal detection based on the output of the crank angle sensor is prohibited in a period in which the crank angle at a time when the drive of the solenoid is started increases by a predetermined angle, so that the reference signal is prevented from being erroneously detected; therefore, the problem, as represented in FIG. 12, in a conventional system is solved, whereby excellent restarting can be performed.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine automatic-stop/restart control system comprising:

a crank angle detection unit that outputs a crank angle signal corresponding to a crank angle of an internal combustion engine;

a reference signal output unit that outputs a reference signal in the crank angle signal when the crank angle signal is situated in a predetermined position;

a reference signal detection unit that detects a reference signal;

a piston position determination unit that determines piston positions of a plurality of cylinders, based on reference signals in the crank angle signal;

an internal combustion engine automatic-stop/restart unit;

a starter motor that is energized to rotate;

a pinion gear provided on the rotation axle of the starter motor;

a plunger for pushing the pinion gear in the axis direction of the rotation axle so that the pinion gear engages with a ring gear provided on a crankshaft of the internal combustion engine; and a solenoid that is energized to move the plunger in the axis direction of the rotation axle, wherein:

the internal combustion engine is controlled in such a way that, while the internal combustion engine inertially rotates after its automatic stop, the solenoid of a starting apparatus for starting the internal combustion engine is driven so that the pinion gear is moved in the axis direction and pushing the pinion gear against the ring gear is started, and detection of the reference signal through the crank angle signal is prohibited until a predetermined period elapses after the pushing has been started.

2. The internal combustion engine automatic-stop/restart control system according to claim 1, wherein the predetermined period is a period in which the crank angle at a time when the pushing is started increases by a predetermined crank angle.

3. The internal combustion engine automatic-stop/restart control system according to claim 1, wherein in the predetermined period in which detection of the reference signal through the crank angle signal is prohibited, a present crank angle is obtained from an output of the crank angle detection unit and a stored last-time crank angle, and when the obtained crank angle becomes a crank angle at which the reference signal is to be outputted, the reference signal is generated.

* * * * *